US011383355B2

(12) United States Patent
Graham et al.

(10) Patent No.: US 11,383,355 B2
(45) Date of Patent: Jul. 12, 2022

(54) SKI TUNING VISE

(71) Applicant: DW PRODUCT DEVELOPMENT INC., Ottawa (CA)

(72) Inventors: Romeo Graham, Montreal (CA); Joseph Luc Boucher, Ottawa (CA); Robert David Watters, Ottawa (CA); Michael Georges Sirois, Ottawa (CA)

( * ) Notice: Subject to any disclaimer, the term of this patent is extended or adjusted under 35 U.S.C. 154(b) by 410 days.

(21) Appl. No.: 16/483,740

(22) PCT Filed: Feb. 5, 2018

(86) PCT No.: PCT/US2018/016933

§ 371 (c)(1),
(2) Date: Aug. 5, 2019

(87) PCT Pub. No.: WO2018/145046

PCT Pub. Date: Aug. 9, 2018

(65) Prior Publication Data

US 2020/0023496 A1 Jan. 23, 2020

Related U.S. Application Data

(60) Provisional application No. 62/454,388, filed on Feb. 3, 2017.

(51) Int. Cl.

| | |
|---|---|
| ***B25B 1/10*** | (2006.01) |
| ***B25B 1/20*** | (2006.01) |
| ***A63C 11/04*** | (2006.01) |
| ***B25B 1/24*** | (2006.01) |

(52) U.S. Cl.

CPC ..... *B25B 1/20* (2013.01); *A63C 11/04* (2013.01); *B25B 1/103* (2013.01); *B25B 1/2405* (2013.01); *B25B 1/2478* (2013.01); *B25B 1/2484* (2013.01); *B25B 1/2489* (2013.01)

(58) Field of Classification Search

CPC ..... B25B 1/103; B25B 1/2478; B25B 1/2405; B25B 1/2484; B25B 1/2452; B25B 5/003; B25B 1/2463; B25B 1/2468; B25B 1/10; B25B 1/2489; B25B 1/2473; B25B 1/20; B25B 1/2457; B25B 1/248; Y10S 269/906; A63C 11/04

USPC ..... 269/154, 43, 906

See application file for complete search history.

(56) References Cited

U.S. PATENT DOCUMENTS

| | | | | |
|---|---|---|---|---|
| 4,943,039 | A * | 7/1990 | Jackson | B25B 5/006 269/45 |
| 5,893,551 | A * | 4/1999 | Cousins | B25B 1/2405 269/43 |
| 8,272,612 | B2 * | 9/2012 | Thorpe | F16B 2/10 248/316.7 |
| 2004/0046091 | A1 * | 3/2004 | Chuang | B25B 1/2484 248/125.1 |
| 2010/0164158 | A1 * | 7/2010 | Weissenborn | F41A 23/18 269/101 |
| 2013/0300048 | A1 * | 11/2013 | Chen | B25B 1/103 269/246 |

(Continued)

*Primary Examiner* — Mahdi H Nejad

(57) ABSTRACT

A vise system is provided to retain a workpiece. In an embodiment, the vise system comprises one or more center vise and one or more end vises. The center vises and end vises are clamped to a table or workbench. The center vise (Continued)

is provided with a front jaw and a rear jaw to retain the center of the work. The end vises are provided with workpiece clamps to retain the ends of the workpiece.

16 Claims, 9 Drawing Sheets

(56) References Cited

U.S. PATENT DOCUMENTS

2019/0160632 A1* 5/2019 Chang ..... B25B 5/062

* cited by examiner

SKI TUNING VISE

CROSS-REFERENCE TO RELATED APPLICATION(S)

The present application is a U.S. National Stage (371) entry claiming priority to Patent Cooperation Treat Application No. PCT/US2018/016933, entitled "Ski Tuning Vise", having an international filing date of Feb. 5, 2018. PCT/US2018/016933 has a priority date of Feb. 3, 2017 corresponding to U.S. Provisional Patent Application No. 62/454,388, entitled "Ski Tuning Vise". The entire disclosures of the PCT and U.S. Provisional applications are incorporated by reference herein.

BACKGROUND

1. Field of Invention

The present invention relates to the field of bench vises, and more specifically to bench vises designed to retain skis and snowboards.

2. Description of Related Art

Vises and clamps have been in use for centuries to allow items to be retained while being worked on by craftsmen from a variety of skilled backgrounds. Clamping a work piece not only provides securement, but safety as well. Attempting to work on an item, which is able to move, can be both frustrating and dangerous for the user or craftsman.

Proper securement of a work piece can be provided with a plurality of clamps, however setting up multiple clamps can be time consuming in most instances. This is especially true if the work being done requires the work piece to be repositioned multiple times. A vise provides a solution to this problem, provided one large clamping mechanism to secure a work piece. However, when the work piece is of a considerable length, a traditional vise may not be able to properly retain the work piece.

For longer work pieces, a very large vise may be provided for proper securement. However larger vises are usually very bulky, expensive, and extremely heavy. If the vise is not large enough, then the work piece may still be able to move. This is especially true if the work piece is comprised of a flexible material. For flexible work pieces, the middle portion may be properly secured, but the tips may be subject to large movements and wobbling due to flex. Proper securement of a long, flexible, work piece could require multiple large, heavy vises.

Another problem is that vises are long in the direction of the axis of motion of the jaw movement. This is because the drive screw and the support rods (guide rails), on currently configured vises, are of fixed dimension and are as long or longer that the effective vice opening dimension. Even with the jaws in the closed state, the spindle and guide exist in the maximum dimension and are not compact in that state.

Based on the foregoing, there is a need in the art for a compact vise system adapted to retain work pieces of significant lengths. What may be further desired is a vise system which is configured to retain workpieces with significant length and flex, such that the undesired movements can be suppressed for safe and efficient work.

SUMMARY OF THE INVENTION

According to an embodiment of the present invention, a vise system is provided having one or more center vises and one or more end vises. In an embodiment, the center vises are comprised of a center block. A center table clamp attached to and positioned below the center block. The center table clamp provides a means to attach a center vise to a table or work bench.

The center vises are further comprised of a front spindle and rear spindle, which are extensible from the center block. A front jaw is positioned on the end of the front spindle and a rear jaw is positioned on the end of the rear spindle. A main crank handle is provided to retract the jaws towards the center vice and clamp the center of the work piece.

The end vises are further comprised of a body with a table clamp. The table clamp provides a means to an end vise to a table or work bench. Each end vise is further provided with a workpiece clamp.

In an embodiment, the vise system is provided such that the center vises and end vises are attached to a table or work bench. The center vises clamp and retain the center of the workpiece, while the end vises retain the ends of the workpiece.

The foregoing, and other features and advantages of the invention, will be apparent from the following, more particular description of various embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION

Figure 1:
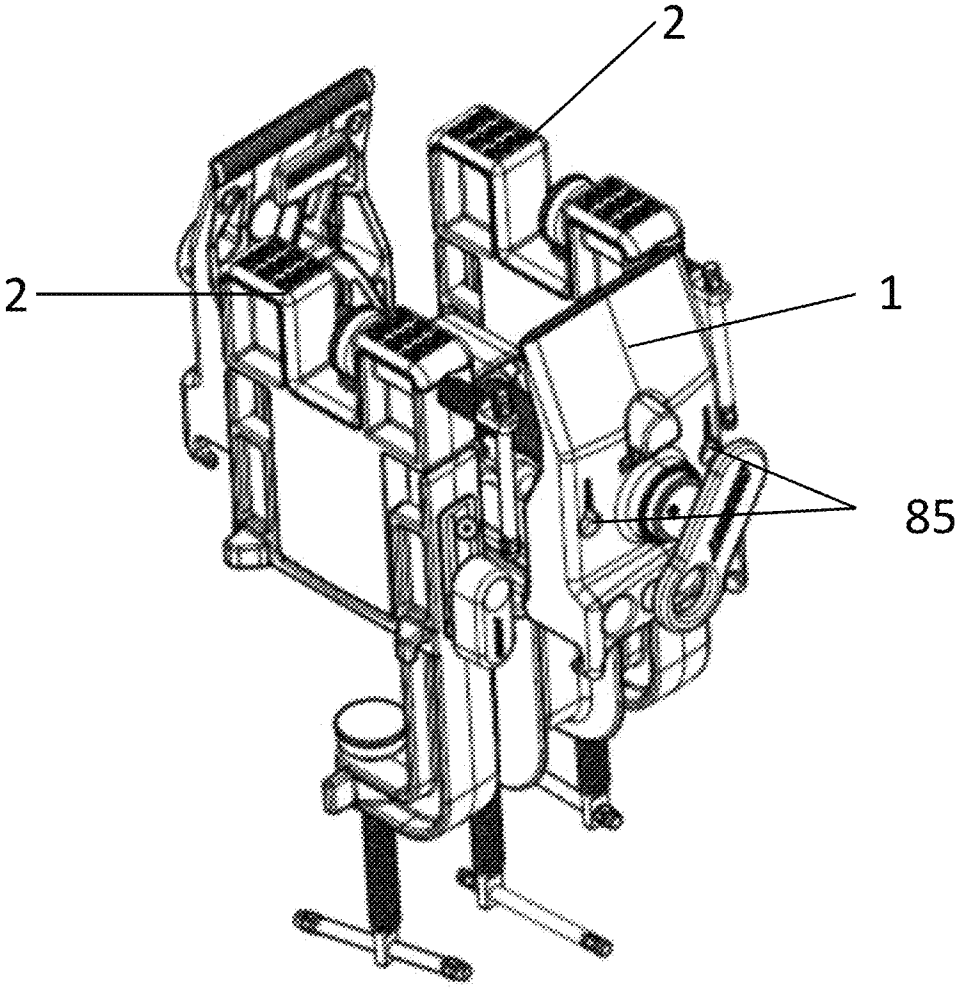
FIG. 1 is a perspective view of the ski tuning vise system, according to an embodiment of the present invention.

Various embodiments of the present invention and their advantages may be understood by referring to FIGS. 1-9, wherein like reference numerals refer to like elements.

Figure 2:
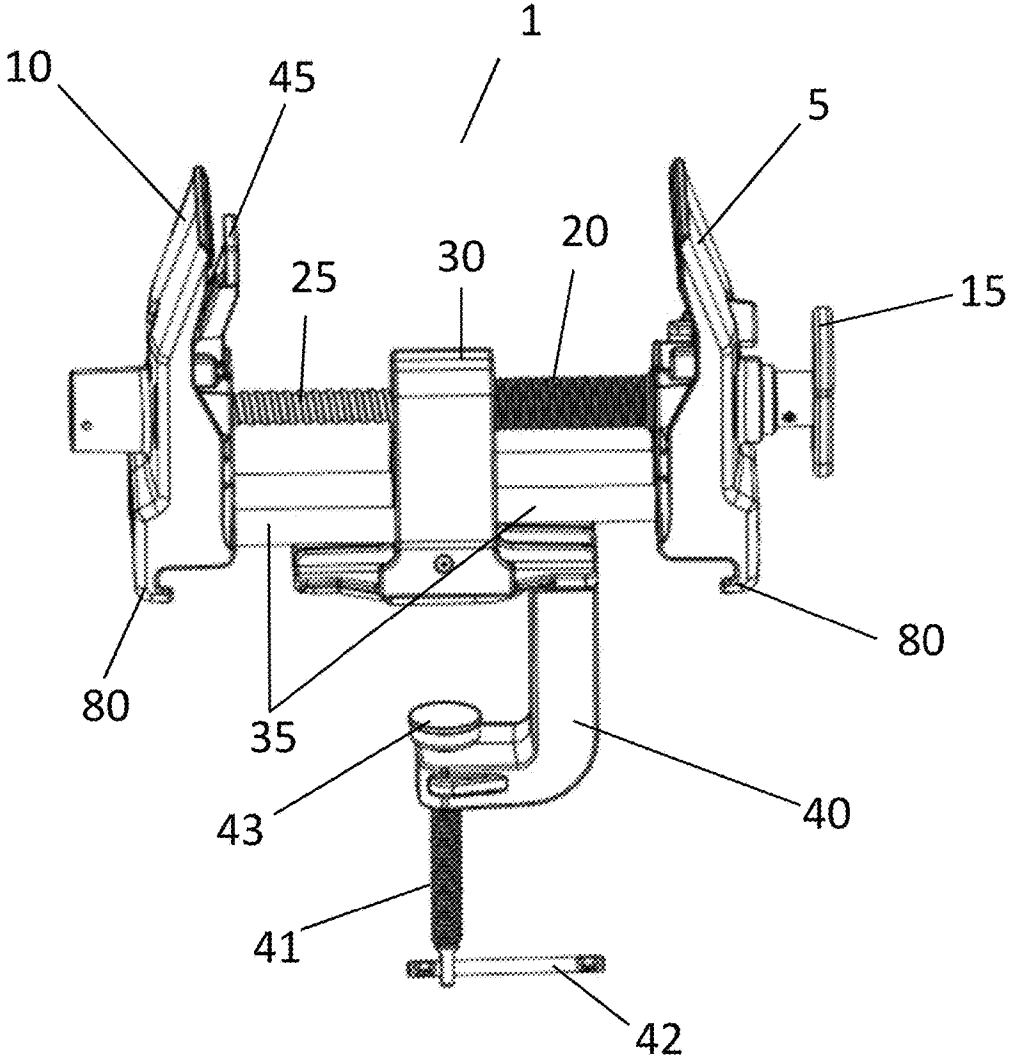
FIG. 2 is a perspective view of the main vise of the ski tuning vise system, according to an embodiment of the present invention.

In reference to FIG. 2, the main vise 1 component of the ski tuning vise is shown. In an embodiment, vise is further comprised of a front clamping jaw 5 and a rear clamping jaw 10. The front jaw and rear jaw are movable via the main crank handle 15, which rotates the front spindle 20. In the embodiment, the front spindle 20 is threaded externally and internally. The external threads of the front spindle 20 are engaged with the center block 30, such that the front jaw 5 moves away from or towards the center block 30 when the main crank handle 15 is rotated. In the embodiment, the internal threads of the front spindle 20 engage with the external threads of the rear spindle 25, such that the rear spindle rotates and the rear jaw 10 is also move when main crank handle 15 is rotated.

Figure 4:
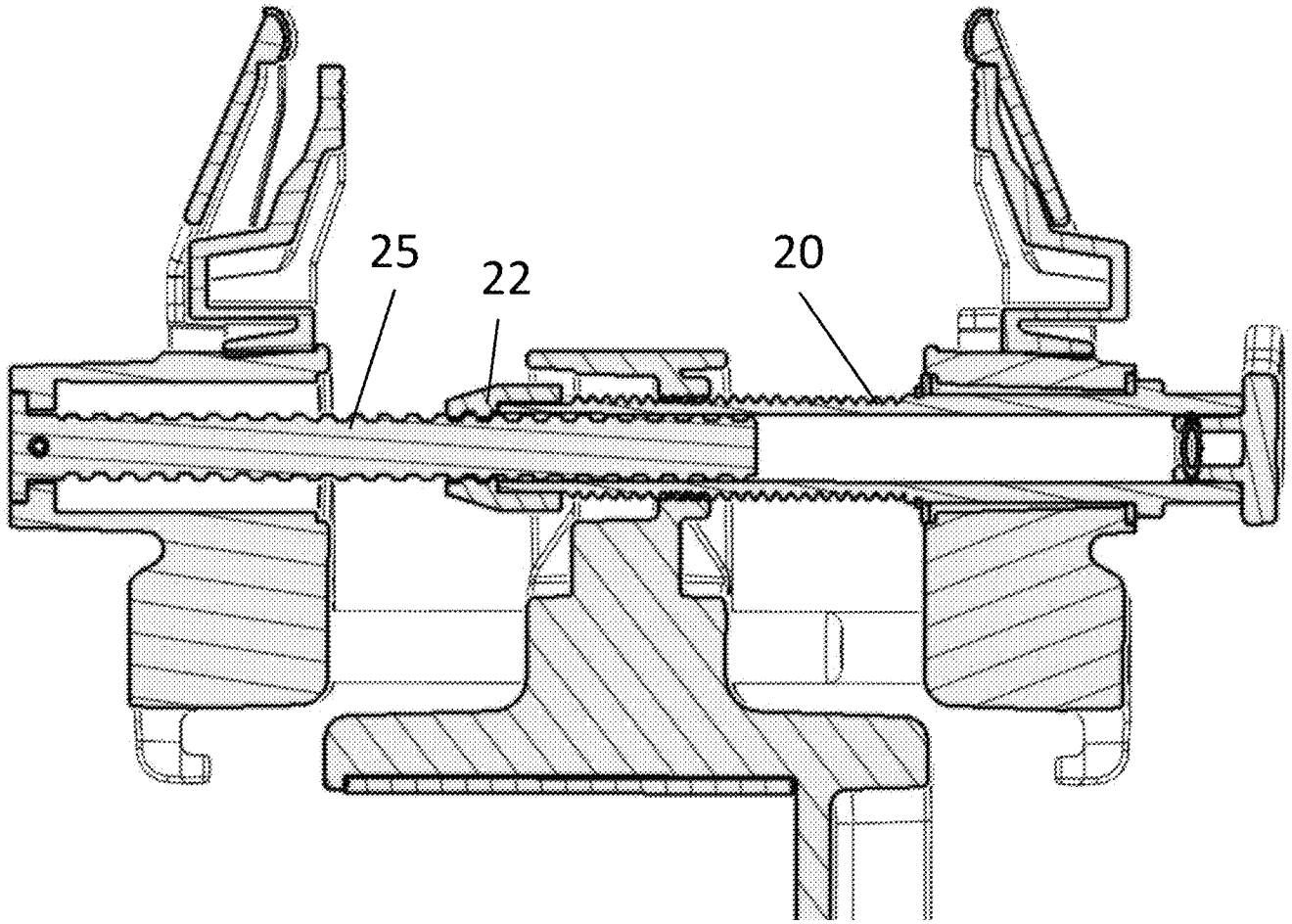
FIG. 4 is a cross-sectional view of the main vise of the ski tuning vise system, according to an embodiment of the present invention.

In reference to FIG. 4, another embodiment of the invention is shown in a cross-sectional view, wherein the inside of the larger, front spindle 20 is not threaded. Instead, the spindle has a threaded and attached nut 22 at the open end. The hollow, front spindle 20 is able to accept the rear spindle 25 that is engaged with the nut 22. This can be a more cost-effective alternative tapping the front spindle to create internal threading throughout its length.

In an embodiment, the internal threading of the front spindle 20, or the threaded nut 22, and external threading of the rear spindle 25 are set at half the pitch of the external threads of the front spindle, such that the front and rear jaws move at the same rate towards each other when the crank handle is rotated. Importantly, the threads of the rear spindle, and the front spindle's internal thread or the front spindle's attached nut's internal thread that are engaged to the rear spindle, are reversed threads to the threads of the external front spindle. The reverse thread arrangement causes the rear jaw to move in the opposite direction as the front jaw. In this configuration, the half pitch arrangement causes the rear jaw to both offset and overcome the direction of motion of the large spindle, ultimately with its jaw moving at the same rate as the front jaw but in the opposite direction. As an example, as the handle is turned to close the front jaw, the front jaw and spindle move towards the rear of the vise. The rear jaw does not move with the front jaw, despite it being engaged with the front jaw via the front spindle, because of the reverse thread relationship, the rear jaw travels in the opposite direction with the rear spindle moving into the large spindle.

In another embodiment, a different pitch ratio may be used, allowing the jaws to move at different rates. Centering the spindles during the initial setup is important to ensure both jaws close on the center at the same time. It should be noted that in another embodiment, the system could be set up such that the handle and the large spindle is configured to the rear of the vise and the smaller spindle and its attached jaw is at the front. In another embodiment, a not centering vise can be desired, where the rear spindle and the external front spindle have the same pitch. Upon turning the handle, the rear jaw would remain stationary relative to the center block 30 and the front jaw would travel. This could be advantageous in allowing for a fixed jaw, and a moving jaw using this collapsed drive mechanism.

In an embodiment, the front jaw 5 and rear jaw 10 are each provided with two hooks 80 to engage with the hooks of the end vises. The arrangement allows for the vise system to be connected for transportation and storage.

In an alternate embodiment (not shown in the figures), a first spiral bevel gear will be provided to engage a helical gear to drive one rack that has a jaw attached to the end. A second bevel gear will also be provided to engage with the first bevel gear and a second rack with another jaw attached to the end. The arrangement is provided, such that turning the first bevel gear will cause the two racks to move in opposite directions. The drive system in this alternate embodiment is compact in its most closed state since the two racks overlap in the direction of the axis of the jaw motion.

In an embodiment, the front and rear jaw are further provided with support rods 35 to prevent bending and warping of the configuration when placed under high loads. In the embodiment, each jaw is provided with two support rods, however it can be appreciated that additional or fewer support rods may be used to obtain the desired effect. These support rods guide the motion of the jaws. It is conceived that the support rods can be made of a range of materials including, polymer, plastic, steel, aluminum or wood. They can be formed using a range of processes including casting, machining, CNC machining, turning, extruded extrusions (hollow), RP additive material. The cross-sectional shape of the support rod/rails can be circular, rectangular, square or other shapes are conceived. The support rods of a single vise could be of differing shapes.

Figure 5:
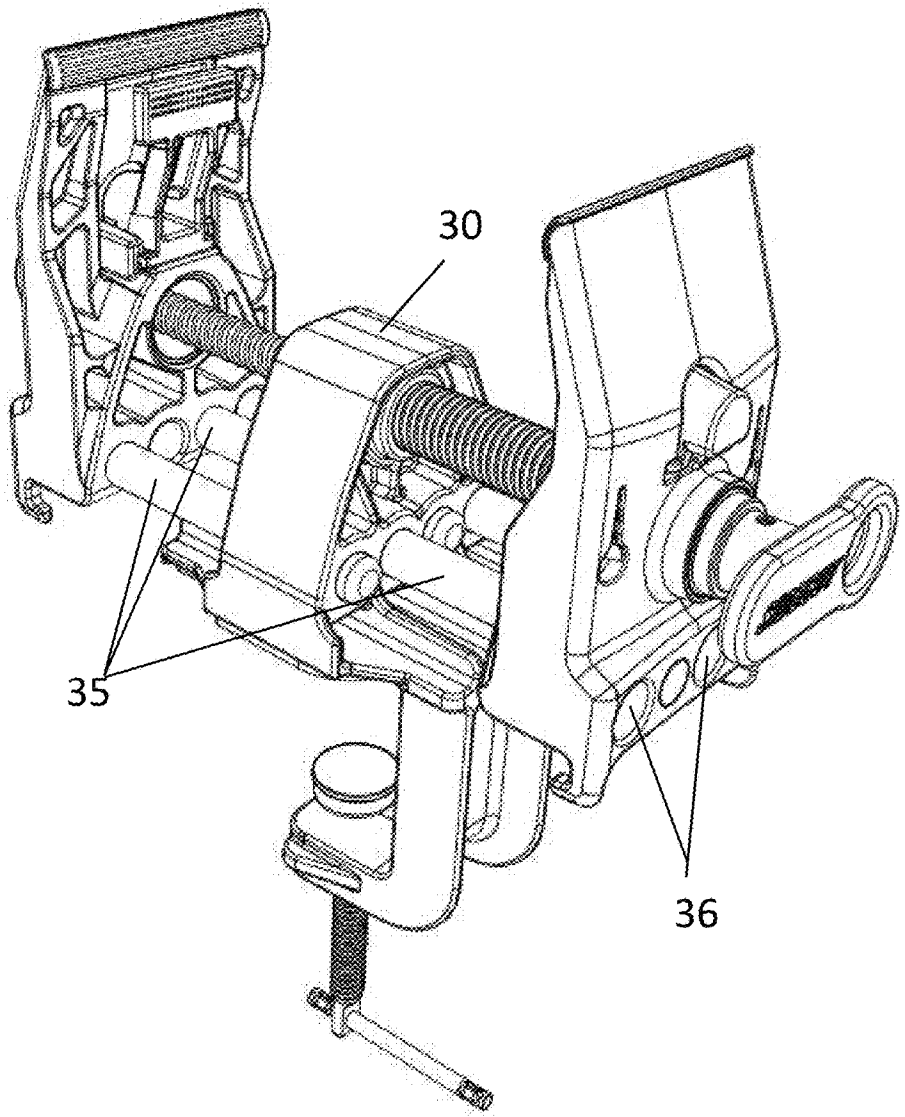
FIG. 5 is a perspective view of a main vise of the ski tuning vise system, according to an embodiment of the present invention.
Figure 6:
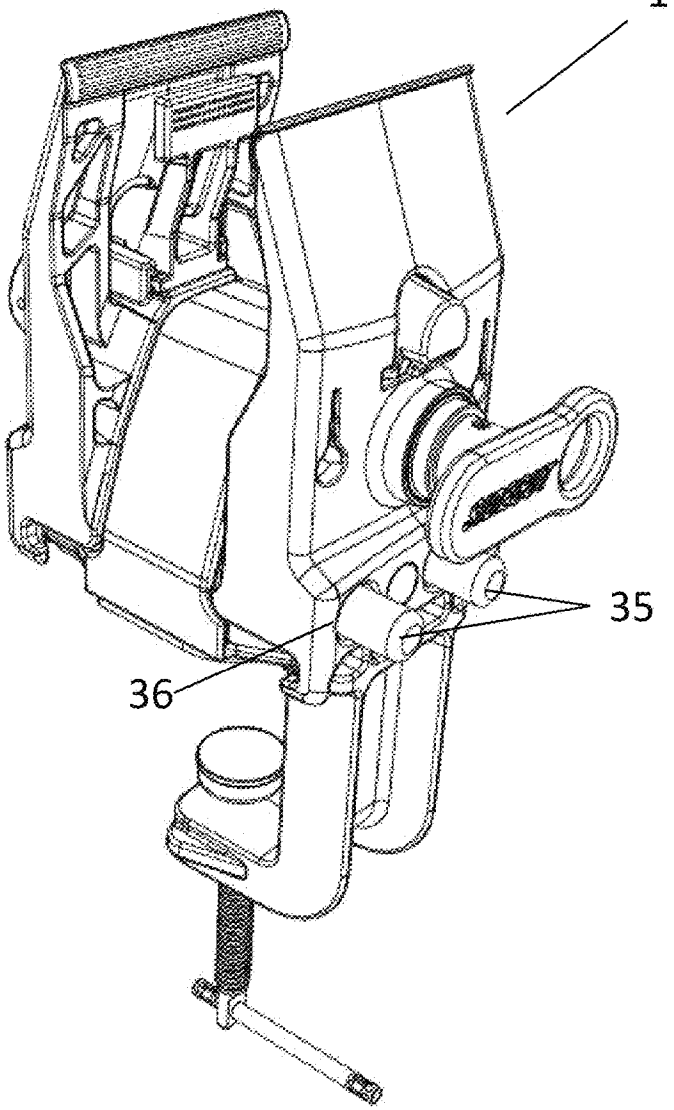
FIG. 6 is a perspective view of the main vise of the ski tuning vise system, according to an embodiment of the present invention.
Figure 7:
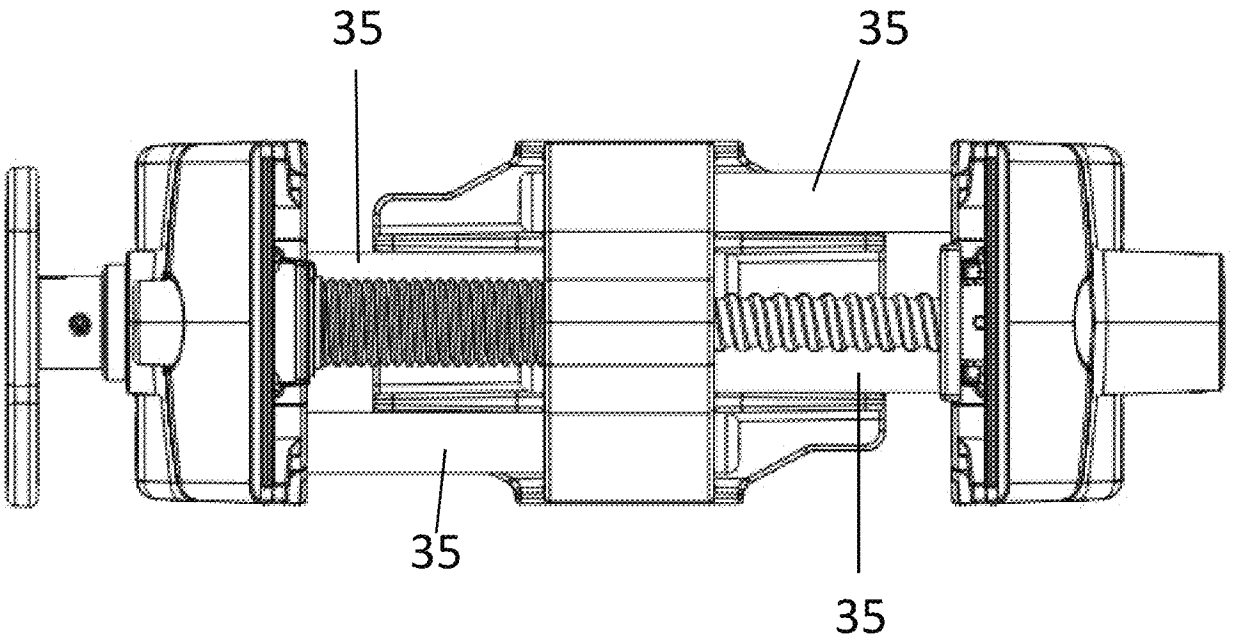
FIG. 7 is a top plan view of the main vise of the ski tuning vise system, according to an embodiment of the present invention.

In reference to FIG. 5-6, an embodiment is shown, wherein each jaw has two support rods. Furthermore, the center block 30 is provided with four through-holes to allow the support rods 35 to pass through. In an embodiment, the through-holes of the center block may contain guide sleeves to smooth motion and reduce play.

In an embodiment, each jaw is also provided with two through-holes 36 to allow the support rods 35 to pass through. In reference to FIG. 5, the main vise 1 is depicted in an open state, wherein the support rods 35 are provided through the through-holes of the center block 30, but do not pass through the through-holes 36 of the jaws. In reference to FIG. 6, the main vise 1 is depicted in a closed state, wherein the support rods 35 are provided through the through-holes 36. In the embodiment, the support rods pass through the center block side by side and at equal distance intervals from one another. Each support rod has a shorter length that the full open travel of the vice. This allows for a compact closed state. In another embodiment, the support rods could be arranged at irregular intervals, they could also be higher and lower than each other while still by passing each other and allow the jaw travel to be guided and the jaw position to be controlled. It is conceived that a vise configuration with the described compact rail supports could be used with a traditional fixed length drive spindle configuration. Inversely, it is conceived that the compact drive system described herein could be used in conjunction to with traditional long fixed length rail support differing from those described herewith.

In an embodiment, depending on the size and capacity of the vise fewer support rods or a greater number of support rods may be selected. In reference to FIG. 6, an embodiment is shown in a top plan view wherein the vise is provided with four support rods 35, and shown in a collapsed state. In the embodiment, the support rods 35 are arranged, such that they will bypass each other, allowing the vise to assume a compact form.

Referring back to FIG. 2, in an embodiment, the center block 30 is attached to a center table clamp 40. In an embodiment, the center table clamp 40 is fixed to the center block 30. In another embodiment, the center block and table clamp may have a rotationally adjustable connection to allow for reorientation of the main vise 1 to the center table clamp 40. This could be planar with the table or tilted. In another embodiment, the center block 30 and the center table clamp 40 are formed integrally.

In an embodiment, the center table clamp is provided with a spindle 41 (threaded through an aperture), handle 42, and shoe 43 to allow the center vise 1 to be secured to a table. In the embodiment shown, the handle 42 is a captured sliding pin, however in another embodiment it may be a hinged handle, which can allow for a linear arrangement for faster rotation.

In an embodiment, the main vise 1 is further comprised of two vertical load supports 45, provided on both the front jaw 5 and the rear jaw 10. The vertical load supports 45 provide support for the weight of the work, reducing the amount of clamping force required to hold the work in place. In an embodiment, the vertical load supports 45 are retractable, such that a user may move them towards the jaw which they are attached to and out of the way. In the embodiment, the supports will slide into their desired position and could be configured with a detent or lock to stay in either the storage or the use position. In other embodiments, the vertical load supports may rotate into position or retain their position via a detents or pressure locking spring sets.

Figure 3:
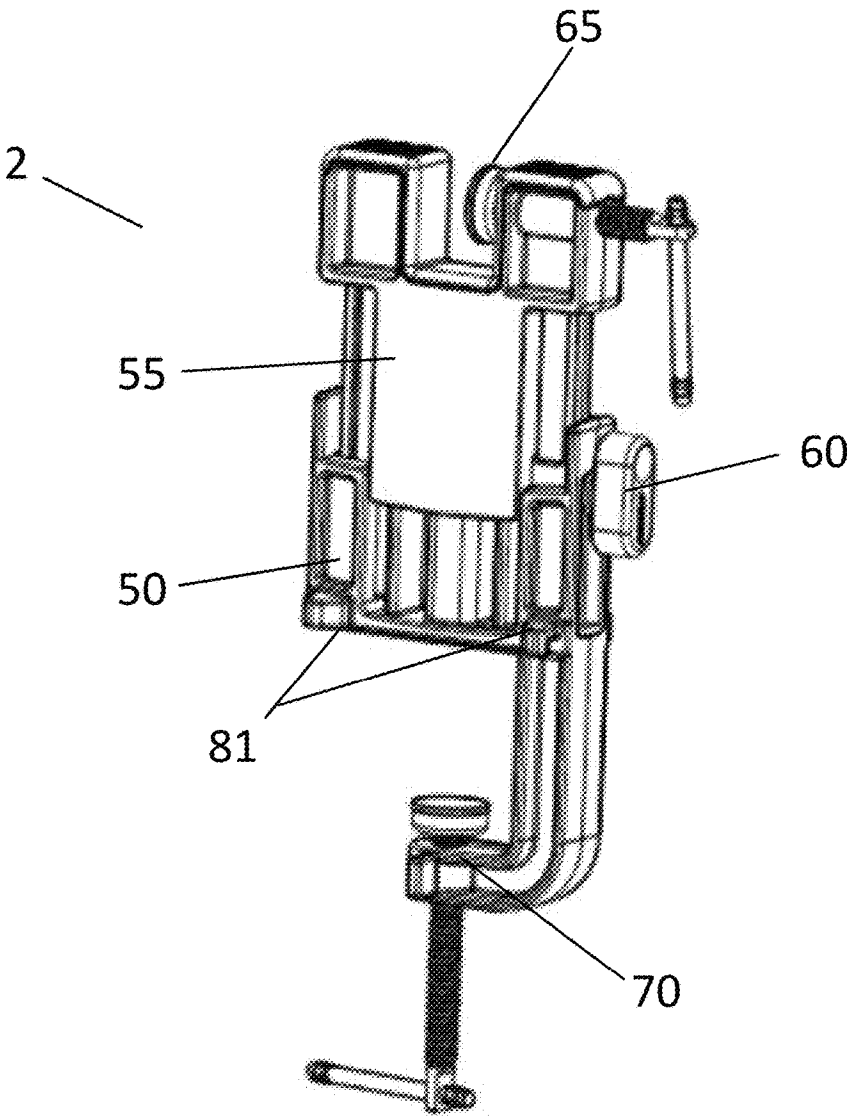
FIG. 3 is a perspective view of an end vise of the ski tuning vise system, according to an embodiment of the present invention.

In reference to FIG. 3, an end vise 2 of the ski tuning vise is shown. In an embodiment, the end vise is comprised of a vertical support 55. The vertical support 55 is adjustable in height, wherein the support slides on a track provided on the body 50 of the end vise. The support is assisted by a compression spring (not shown), and may be locked into to place by tightening the support lock 60. It can be understood that a tension spring could also be arranged to assist with raising the vertical support.

The end vise is further provided with a top clamping assembly 65, wherein a spindle, shoe, and handle are provided on one side of the vertical support 55. The arrangement is provided such that a work piece may be placed between the shoe and side wall and clamped in position by rotating the handle. In the embodiment shown, the handle is a captured sliding pin, however in another embodiment it may be a hinged handle, which can allow for a linear arrangement for faster rotation.

In the embodiment, shown in FIG. 3, the clamping assembly is provided on the front portion of the vertical support. However, it may be appreciated that if the clamping assembly is provided on the rear portion of the vertical support, then the work piece will be retained closer to the user.

Figure 8:
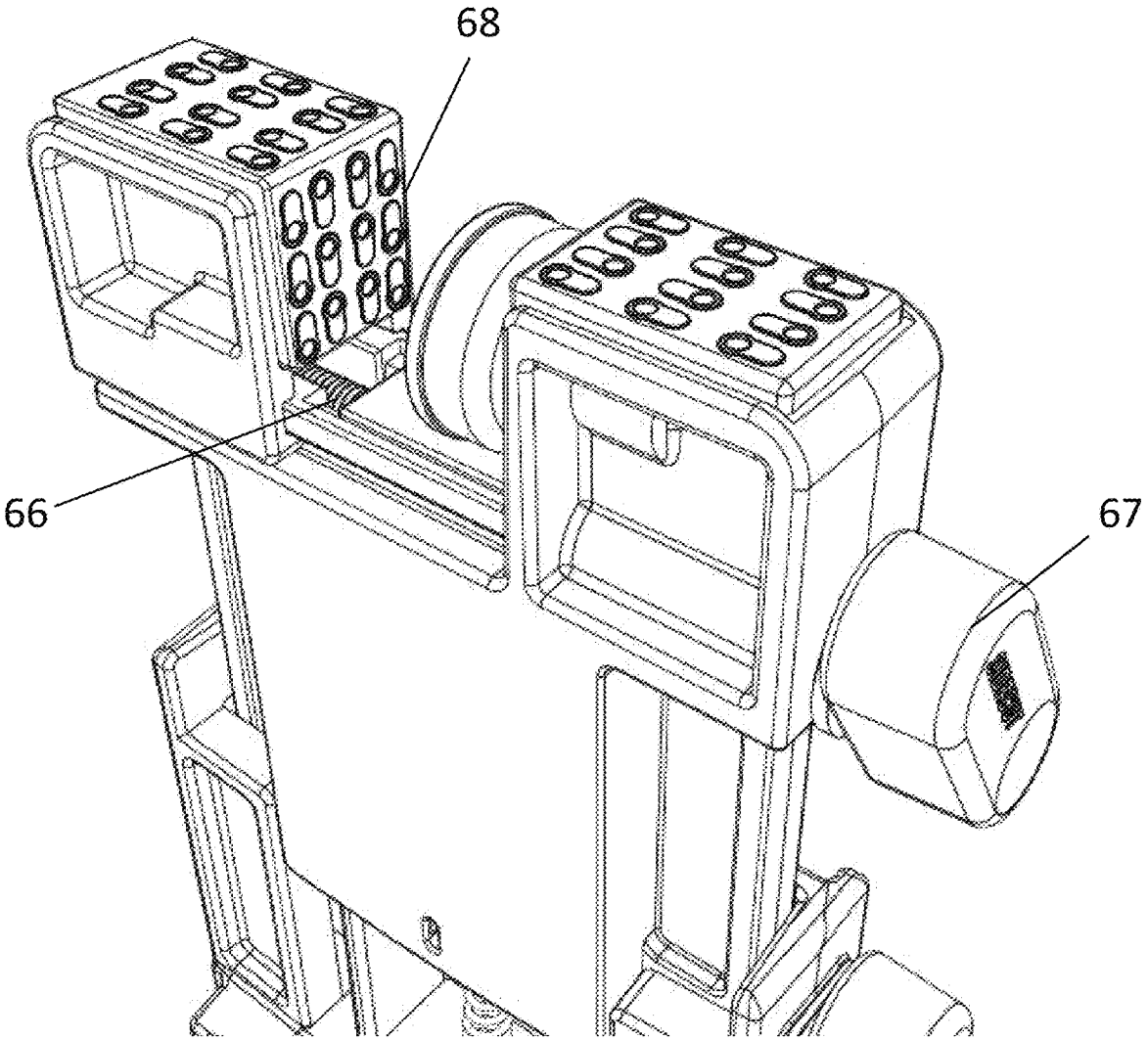
FIG. 8 is a perspective view of the end vise of the ski tuning vise system, according to an embodiment of the present invention.

In another embodiment, as shown in FIG. 8, the end vise has another top clamping assembly arrangement on the vertical support. There is no moving shoe, instead a spindle 66 is connect to and driven by a front handle 67. The drive is rotatably engaged with a rear traveling clamping member 68. This clamping member is slidably engaged with the vertical support and moves from the rear to the front of the block to clamp the workpiece to a fixed front wall with a mounted shoe.

Figure 9:
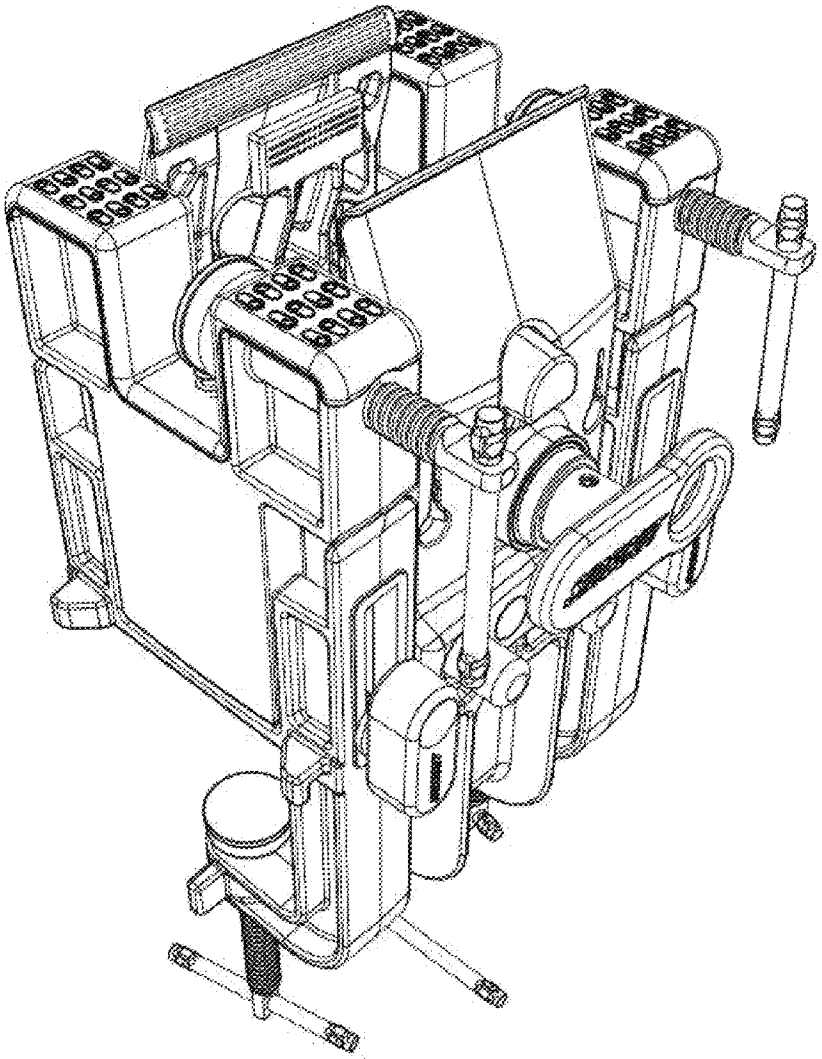
FIG. 9 is a perspective view of the ski tuning vise system, according to an embodiment of the present invention.

In an embodiment, the end vice is further comprised of a table clamp 70 which extends down from the body 50 of the end vise. The table clamp is comprised of a handle, spindle, and shoe arrangement which is tightens towards the body of the end vise. In the embodiment shown, the handle is a captured sliding pin, however in another embodiment it may be a hinged handle, which can allow for a linear arrangement for faster rotation. The table clamp 70 allows the end vise to be secured to a table or work bench. In an embodiment, the body of the end vise is further provided with four hooks 81 to allow the end vise to connect with the main vise. The arrangement of four hooks allows the end vise to be placed on either side of the main vice while having the table clamp features oriented in the same direction and the user can slide the three vises together while on the table and lock them together by closing the main jaws and engaging the hooks. FIG. 9 shows the clamp in a compact state, wherein the main vise is closed such that end vise hooks are engaged with the main vise hooks.

In reference to FIG. 1, the main vise 1 is shown to be interconnected with two end vises 2. The end vises 2 and main vise 1 may be interconnected via the hooks provided on the components. The combination of the main vise and end vises allows a user to position the end vises away from the main vise to be clamped on a table or work bench. This allows the system of vises to appropriately accommodate work pieces of various lengths.

In an embodiment, both the front jaw 5 and rear jaw 10 of the main vise 1 are provided with two eyelets 85 to allow a string or cord to be inserted and wedged into the narrow end of the eyelet. Moving the vises outward will create tension on the cord or string to provide a downward force on a work piece help retain it in the vise. This method may be especially useful for fragile work pieces, wherein the jaws of the vise may damage the work piece, or for irregularly shaped workpieces which are difficult to clamp into the jaws of the vise.

In an embodiment, the ski tuning vise system is configured to retain a ski or snowboard. Wherein, the main vise 1 retains the middle of the skis or snowboard, and the end vises 2 retain the tips of the skis or snowboard to prevent them from flexing while being worked on. However, it can be appreciated that the vise system may also be used on other work pieces of significant length or prone to flexing, such as: guns, piping, wooden boards, musical instruments, etc. It can also be appreciated that certain items that are not particularly long could benefit from the use of this center vise only. This maybe because of the centered motion of this vise, because of its compactness or its versatile ability to clamp may types of items. Areas of the vice that may contact the work being clamped, have preferred materials qualities that are integrated or applied to ensure that the work being held it not damage. These materials can include elastomers, polymer, felt, foam, low durometer plastics or other similar and known to those familiar to the art.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

We claim:

1. A vise system to retain a workpiece having:

a. a center vise comprising i. a center block;

ii. a center table clamp attached to a bottom side of the center block;

iii. a front spindle extensible from a front side of the center block, the front spindle being externally threaded to engage with a threaded aperture provided on the center block;

iv. a rear spindle extensible from a rear side of the center block, the rear spindle being externally threaded to couple with the front spindle;

v. a front jaw positioned on an end of the front spindle, the front jaw having a support rod extending towards the center block; and vi. a rear jaw positioned on an end of the rear spindle, the rear jaw for opposing the front jaw, the rear jaw having a support rod extending towards the center block, wherein a user rotates a main crank handle to change a distance between the front jaw and the rear jaw, and wherein a weight of the workpiece is supported by the vertical support rod of the front jaw and the vertical support rod of the rear jaw; the vise system further having:

b. one or more end vises, each end vise comprising i. a body provided with a table clamp;

ii. a vertical support slidably engaged with the body, the vertical support further having a workpiece clamp; and iii. a support lock to lock the vertical support in a position relative to the body, wherein the center table clamp of the center vise is clamped to a table, and wherein each table clamp of the one or more end vises is clamped to the table, and wherein a center of the workpiece is retained between the front jaw and the rear jaw of the center vise, and wherein ends of the workpiece are retained by each table clamp of the one or more end vises.

2. The vise system of claim 1, wherein the center vise is further comprised of two or more support rods, wherein at least one of the two or more the support rods extends from the front jaw to the center block and wherein at least one of the two or more the support rods extends from the rear jaw to the center block.

3. The vise system of claim 1, wherein the rear spindle is coupled with the front spindle via a nut provided on the front spindle.

4. The vise system of claim 2, wherein the rear spindle is externally threaded to engage with a nut provided on the front spindle, and wherein the front spindle is externally threaded to engage with a threaded aperture provided on the center block.

5. The vise system of claim 1, wherein the vise system comprises exactly two end vises.

6. The vise system of claim 5, wherein the center vise further comprises one or more hooks, and wherein the exactly two one or more end vises are further comprised of one or more connecting hooks, and wherein the one or more hooks of the center vise engage ones of the one or more connecting hooks of the exactly two end vises, such that the user may carry the exactly two end vises and the center vise as a single unit.

7. The vise system of claim 1, wherein each workpiece clamp of one or more end vises are comprised of a travelling clamping member, wherein the travelling clamping member is moved by the user rotating a handle, and wherein the workpiece is clamped between the travelling clamping member and a fixed clamp shoe.

8. A vise system to retain a workpiece having:

a. one or more center vises, each center vise comprising i. a center block;

ii. a center table clamp attached to a bottom side of the center block;

iii. a front spindle extensible from a front side of the center block, the front spindle being externally threaded to engage with a threaded aperture provided on the center block;

iv. a rear spindle extensible from a rear side of the center block, the rear spindle being externally threaded to couple with the front spindle;

v. a front jaw positioned on an end of the front spindle; and vi. a rear jaw positioned on an end of the rear spindle, the vise system further having:

b. one or more end vises, each end vise comprising i. a body provided with a table clamp; and ii. a workpiece clamp, wherein each center table clamp of the one or more center vises is clamped to a table, and wherein each table clamp of the one or more end vises is clamped to the table, and wherein a user rotates a main crank handle of each of the one or more center vises to clamp a center of the workpiece between the front jaw and the rear jaw of the one or more center vises, and wherein ends of the workpiece are retained by each workpiece clamp of the one or more end vises.

9. The vise system of claim 8, wherein the each center vise of the one or more center vises is further comprised of two or more support rods, wherein at least one of the two or more the support rods extends from the front jaw to the center block and wherein at least one of the two or more the support rods extends from the rear jaw to the center block.

10. The vise system of claim 9, wherein the rear spindle is externally threaded to engage with a nut provided on the front spindle, and wherein the front spindle is externally threaded to engage with a threaded aperture provided on the center block.

11. The vise system of claim 8, wherein the rear spindle is coupled with the front spindle via a nut provided on the front spindle.

12. The vise system of claim 8, wherein the vise system comprises exactly two end vises.

13. The vise system of claim 12, wherein each center vise of the one or more center vises further comprises one or more hooks, and wherein the exactly two end vises are further comprised of one or more connecting hooks, and wherein the one or more hooks of each center vise engage ones of the one or more connecting hooks of the exactly two end vises, such that the user may carry the exactly two end vises and each center vise as a single unit.

14. The vise system of claim 8, wherein each workpiece clamp of one or more end vises are comprised of a travelling clamping member, wherein the travelling clamping member is moved by the user rotating a handle, and wherein the workpiece is clamped between the travelling clamping member and a fixed clamp shoe.

15. The vise system of claim 8, wherein each of the one or more end vises are further comprised of a vertical support slidably engaged with the body, the vertical support further having a workpiece clamp; and a support lock to lock the vertical support in a position relative to the body.

16. The vise system of claim 8, wherein each of the one or more center vises are further provided with a vertical support extending from the front jaw and a vertical support extending from the rear jaw.

* * * * *